United States Patent [19]

Hortlik et al.

[11] 3,990,225

[45] Nov. 9, 1976

[54] OPEN-END SPINNING MACHINE

[75] Inventors: Frantisek Hortlik; Josef Ripka, both of Usti nad Orlici; Vaclav Vobornik, Letohrad; Jan Junek; Frantisek Jaros, both of Usti nad Orlici; Jiri Elias, Brandys nad Orlici; Miroslav Esser, Ceska Trebova; Agaton Planansky, Usti nad Orlici, all of Czechoslovakia

[73] Assignee: Vyzkumny Ustav Bavonarsky, Usti nad Orlici, Czechoslovakia

[22] Filed: Oct. 22, 1974

[21] Appl. No.: 516,909

[30] Foreign Application Priority Data

| | | |
|---|---|---|
| Oct. 24, 1973 | Czechoslovakia | 7310-73 |
| Oct. 24, 1973 | Czechoslovakia | 7311-73 |
| Oct. 24, 1973 | Czechoslovakia | 7313-73 |

[52] U.S. Cl. ..... 57/58.95; 57/58.91

[51] Int. Cl.[2] ..... D01H 1/12

[58] Field of Search ..... 57/58.89–58.95, 57/100

[56] References Cited

UNITED STATES PATENTS

| | | | |
|---|---|---|---|
| 3,355,869 | 12/1967 | Vorisek | 57/58.95 |
| 3,511,045 | 5/1970 | Bures et al. | 57/58.91 |
| 3,698,175 | 10/1972 | Dykast | 57/58.89 |
| 3,712,042 | 1/1973 | Chrtek et al. | 57/58.95 |
| 3,747,998 | 7/1973 | Klein et al. | 57/58.89 Ux |
| 3,760,577 | 9/1973 | Kihara et al. | 57/58.89 X |
| 3,762,144 | 10/1973 | Didek et al. | 57/58.91 |
| 3,810,352 | 5/1974 | Miyazaki et al. | 57/58.95 X |
| 3,877,212 | 4/1975 | Canzler | 57/100 |

*Primary Examiner*—John Petrakes

[57] ABSTRACT

Open-end spinning unit having two housings connected to each other, a first housing containing a spinning rotor adapted to be supplied through a supply duct with separated fibers carried by an air stream while yarn is withdrawn therefrom through a take-off duct, the second housing containing a sliver supply roller and a combing-out cylinder followed by said fiber supply duct extending through a lid inserted into the spinning rotor and forming a part of said second housing, the spinning rotor being surrounded with an air collecting space adapted to collect the air to be withdrawn from the spinning rotor. The spinning rotor turns about a vertical axis of rotation and is driven by an individual motor through the axis of which the yarn take-off duct extends in an upward direction. The lower front part of the spinning rotor extends into a cavity provided in the top part of said second housing. The combing-out cylinder and the sliver supply roller have horizontal axes of rotation perpendicular to the longitudinal axis of the open-end spinning machine. The top of said cavity is covered by said first housing while the cavity forms said air collecting space, a central part of the bottom of said cavity being formed by said lid.

7 Claims, 6 Drawing Figures

OPEN-END SPINNING MACHINE

The present invention relates to an open-end spinning unit comprising a housing containing a spinning rotor into a front opening of which a stationary lid is inserted. A fiber supply duct extends through the lid, the duct discharging into the interior of the spinning rotor. The opened or separated fibers conveyed by air stream through said supply duct are directed towards a directing wall within the rotor and from such directing wall onto a collecting surface where they form a fibrous ribbon to be twisted to yarn by the rotation of the rotor; yarn is then withdrawn from the rotor through a yarn take-off duct. The housing receiving the spinning rotor is attached to or communicates with another housing receiving a fiber separating device comprising a sliver supply roller and a combin-out cylinder followed by the aforementioned fiber supply duct extending, as hereinabove set forth, through said lid. The spinning rotor is surrounded by a space for collecting air to be withdrawn from the spinning rotor.

Most of the well-known open-end spinning unit constructions have a common disadvantage: In case of a necessary operation to be made by the attendants in the interior of the spinning unit, as for instance, if the unit is choked with fibers or impurities, or in case of a mechanical failure, the respective parts of the spinning unit have to be disassembled. This process is rather time-consuming.

This disadvantage is partly overcome by using a spinning unit wherein the housing for the fiber separating device is tiltably supported by a through shaft for driving the sliver supply rollers, while the spinning rotor housing is pivotally arranged on the machine frame, said two housings being hinged to each other. The tilting of the rotor housing away from the operating position, which, after all, is carried out much more frequently than the tilting of the separating device housing, cannot be accomplished with this construction independently from the tilting of the last-mentioned housing; furthermore, the construction permits a limited opening angle of the two housings only, so that the access to the operating parts is difficult.

The above-described known open-end spinning unit comprises a horizontally disposed spinning rotor and a common tangential drive mechanism for a plurality of such units so that, upon the tilting away of the rotor housing, the rotor is disengaged from a driving belt and comes to a standstill. The spinning rotor is provided with ventilating ports through which air is blown out into an air-collecting space provided in its housing and surrounding the spinning rotor; the housing has to be provided at its front side with an appropriate sealing element to cut off the air collecting space from the ambient atmosphere. With such an arrangement of the air-collecting space in the spinning rotor housing, said space, when the rotor housing is tilted away from the operative position, is disconnected from the central air take-off duct so that it is rendered unusable for withdrawing impurities to be removed from the rotor interior; the sealing element makes access to the air-collecting space impossible, so that the same cannot be cleaned without disassembling the respective parts from one another.

Apart from this, in this arrangement of the air-collecting space in the housing of the spinning rotor with a horizontal axis of rotation, the central air take-off cannot continuously communicate with said air-collecting space so that the air to be withdrawn is twice deflected through 90° angles.

Further, it is to be understood that when using the common tangential drive for a plurality of units it is not possible to stop the individual spinning rotors in case of a yarn breakage without the intervention of the operator. In this way power losses occur which are particularly significant with high-speed spinning rotors.

The afore-described prior open-end spinning unit is further characterized by a counterflow of the fibers supplied to the rotor and the yarn taken off from the spinning rotor, respectively, which means that both the fiber supply duct and the yarn take-off duct extend through said lid inserted into the rotor. Thus the yarn take-off duct also extends through the separating device housing in which its path turns 90° from the horizontal to the vertical, so that the duct discharges at the top side of the housing above which the yarn take-off rollers and the winding mechanism are disposed.

The above-described known spinning unit construction has a plurality of drawbacks, as partly hereinabove referred to, which drawbacks particularly manifest themselves at high rotor speed; thus this known unit is not suitable for use with highly productive open-end spinning machines with high-speed rotors.

As is generally known, to keep the spinning process continuous, the axial forces to which the yarn is exposed at any point of its path of travel, i.e. from the twist zone to the winding zone, must not exceed the strength of the minimum yarn. Any increase in the speed of the rotor results in an increase in the axial forces to which the yarn is subjected caused by centrifugal force. Because of this, when rotor speed is increased, it is necessary to reduce the diameter of the collecting surface of the spinning rotor from which the yarn is withdrawn. However, with the afore-described spinning unit construction operating on the basis of the counterflow prinicple, the possibility of reducing the rotor diameter is limited by the necessity of keeping such a diameter of the front rotor opening sufficiently large so as to allow the simultaneous passage of both the fiber supply and the yarn take-off duct through the lid inserted into said front rotor opening.

Apart from this, the conditions for increasing the rotor speed are limited here by the necessity of leading the yarn through a bent portion of the take-off duct where, due to friction, a further increase of axial forces imposed upon the yarn occurs.

On the other hand, there are some known open-end spinning units operating upon the principle of co-current material flow in the spinning rotor. In such units the air collecting space is provided in the housing for the spinning rotor, such rotor being driven by a tangential belt; these units also have many other disadvantages. Apart from this, as already hereinabove referred to, with said spinning units access to the interior of the spinning rotor in the inoperative condition by the machine operator has not been satisfactorily solved.

It is an object of the invention to provide an open-end spinning unit which overcomes the above drawbacks of prior art devices, which permits a substantial increase in the speed of the rotor and minimizes power losses.

Another object of the present invention is to maintain the essential advantage of the above-described well-known unit construction, i.e. to enable the rotor housing to be easily tilted, while simplifying the tilting motion, to improve as well as to facilitate access to the spinning rotor and to the air-collecting space in the tilted away position, and finally to improve the conditions for cleaning the rotor and the said air-collecting space.

In order to remove or at least to mitigate the disadvantages of the prior art, in accordance with the invention there is provided an improved open-end spinning unit comprising two housings connected to each other, of which the first receives a spinning rotor adapted to be supplied through a supply duct with separated fibers carried by an air stream while yarn is withdrawn therefrom through a take-off duct, the second housing receiving a sliver supply roller and a combing-out cylinder followed by said fiber supply duct extending through a lid inserted into the spinning rotor and forming a part of said second housing, i.e. the housing of a fiber separating device, the spinning rotor being surrounded with an air-collecting space adapted to collect the air being withdrawn from the spinning rotor.

In the unit in accordance with the invention, the spinning rotor has the vertical axis of rotation driven by an individual motor. The yarn take-off duct extends in an upward direction through the axis of the motor and the rotor. The lower front part of the rotor is inserted into a cavity provided in the top part of the second housing, in which the combing-out cylinder and the sliver supply roller rotate on horizontal axes of rotation perpendicular to the longitudinal axis of the rotor and motor of the open-end spinning machine. The cavity in the top part of the second housing is covered from above by said first housing, and forms said air-collecting space around the spinning rotor, a central part of the bottom of said cavity being constituted by said lid.

Since the spinning rotor is arranged vertically and the yarn is withdrawn therefrom through a straight vertical take-off duct, the path of the yarn in said duct is straight and the stress imposed upon the yarn is reduced. Furthermore, since the housing for the spinning rotor is disposed above the housing of the fiber separating device, and since the spinning unit operates upon the co-current material flow principle, the fiber supply being situated at the lower side of the rotor while the yarn take-off is disposed at the upper side of the rotor, the fiber supply duct and the yarn take-off duct do not both extend through the lid. It is thus possible to reduce the dimensions of the spinning rotor and to raise its speed of rotation without incurring an inappropriate rise in the value of the axial forces imposed upon the yarn. Apart from this, the air-collecting space, having a vertical axis, can communicate directly with a central air offtake duct to withdraw the air from the spinning rotor substantially in a straight course, whereby power losses are reduced.

The location of the aforementioned air-collecting space in a cavity provided in the housing of the fiber separating device is very advantageous. When the spinning rotor housing is tilted away from the separating device housing and the rotor is disengaged from said cavity it is also tilted away from said air-collecting space, whereby access to said space as well as the possibility of cleaning it are facilitated. Apart from this, since the air-collecting space permanently communicates with the central air take-off duct, even after the spinning rotor has come to a standstill, impurities from the rotor can be swept into the aforesaid cavity and easily be withdrawn therefrom into said duct.

Further, the location in the separating device housing of the combing-out cylinder and the sliver supply roller, both of which have horizontal axes of rotation perpendicular to the axis of rotation of the rotor, is particularly advantageous from the constructional view-point since it permits the horizontal arrangement of a tangential belt for the common drive of the combing-out cylinders and facilitates belt exchange as well as access to the driving means as a whole.

The provision of the open-end spinning unit with a vertical rotor axis according to the invention and the arrangement of the rotor housing above the separating device housing enables sliver supply cans to be placed immediately below the spinning unit.

In order to make the spinning rotor housing tiltable independently of the position of the housing for the separating device, in the top part of the separating device housing there are provided means for pivotally supporting the rotor housing upon the housing for the separating device around an axis parallel with the longitudinal machine axis said means enabling the tilting of the rotor housing. The range of such tilting extends from an operative position in which the lower front wall of the rotor housing bears upon the mating upper front wall of the separating device housing, i.e. upon the top edge of the cavity, to an inoperative position in which the rotor housing bears upon a stop. Since the spinning rotor housing is not attached to the machine frame, but supported only by the separating device, it can be tilted any time when desired; the tilt angle, which is limited only by the position of the stop, can be sufficiently great to enable easy access to the rotor by the machine operator.

An effective sealing and damping of vibrations can be attained by incorporating an elastic gasket between the afore-mentioned mating front walls of the two housings.

To improve the stability of the spinning rotor housing, at least one of the two mating front walls of the two housings may be provided with means for magnetically attracting the housings to each other.

To permit an easier manipulation of the second, fiber separating device housing, to facilitate access to the combing-out driving means and to permit an exchange of the driving belt or its supporting pulleys, or an adjustment and cleaning of the fiber separating means in accordance with the invention, a transmission mechanism is associated with the sliver supply roller, which mechanism is coupled to a driving shaft extending in parallel with the length of the machine. The second housing is supported by said driving shaft to swing from an operative position, in which a pulley on the axis of the combing-out cylinder is in engagement with a common tangential drive belt, selectively engaged by pulleys of the combing-out cylinders of a plurality of juxtaposed open-end spinning units, into an inoperative position in which said pulley is spaced apart from said belt. Said belt drive and its supporting pulleys are received in a longitudinal recess provided in the machine frame; in said longitudinal recess there is preferably disposed a brake to engage said pulley in said inoperative position of said second housing.

In accordance with the invention, the machine frame portion having the longitudinal recess may be provided on its top part with a flange adapted to cooperate with a pawl provided on said second housing, to secure said second housing in its operative position by the engagement of said pawl with said flange.

In order that the invention may be better understood and carried into practice, some preferred embodiments thereof will be hereinafter described with reference to the accompanying schematic drawings which, however, are not intended to limit in any way the scope of the invention.

Figure 3:
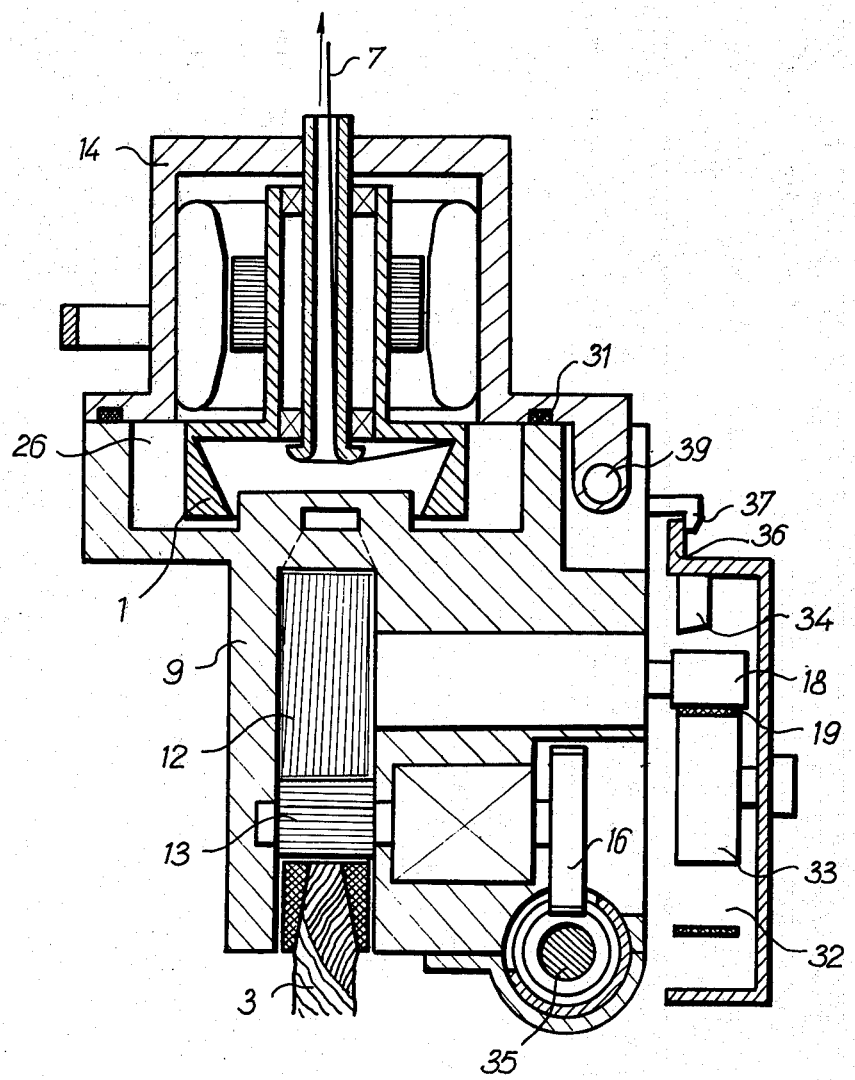
Figure 4:
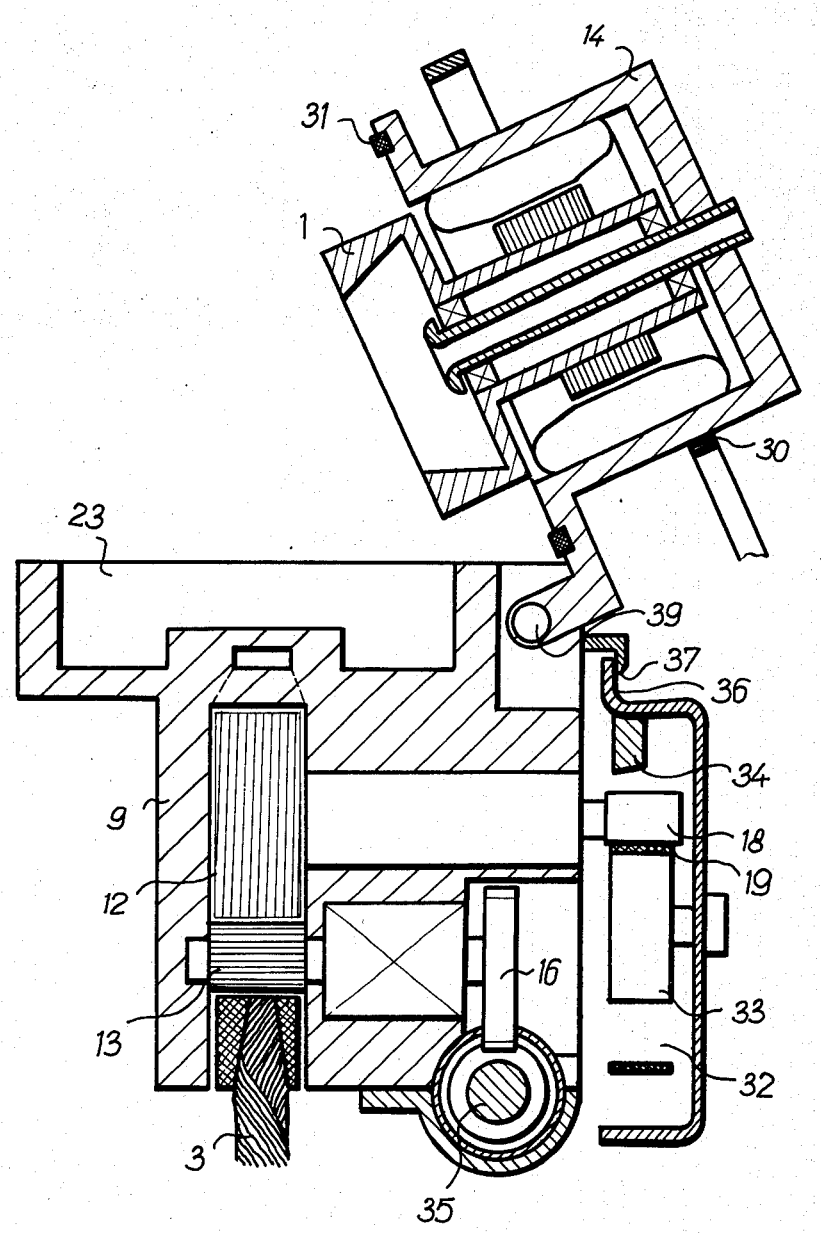
Figure 5:
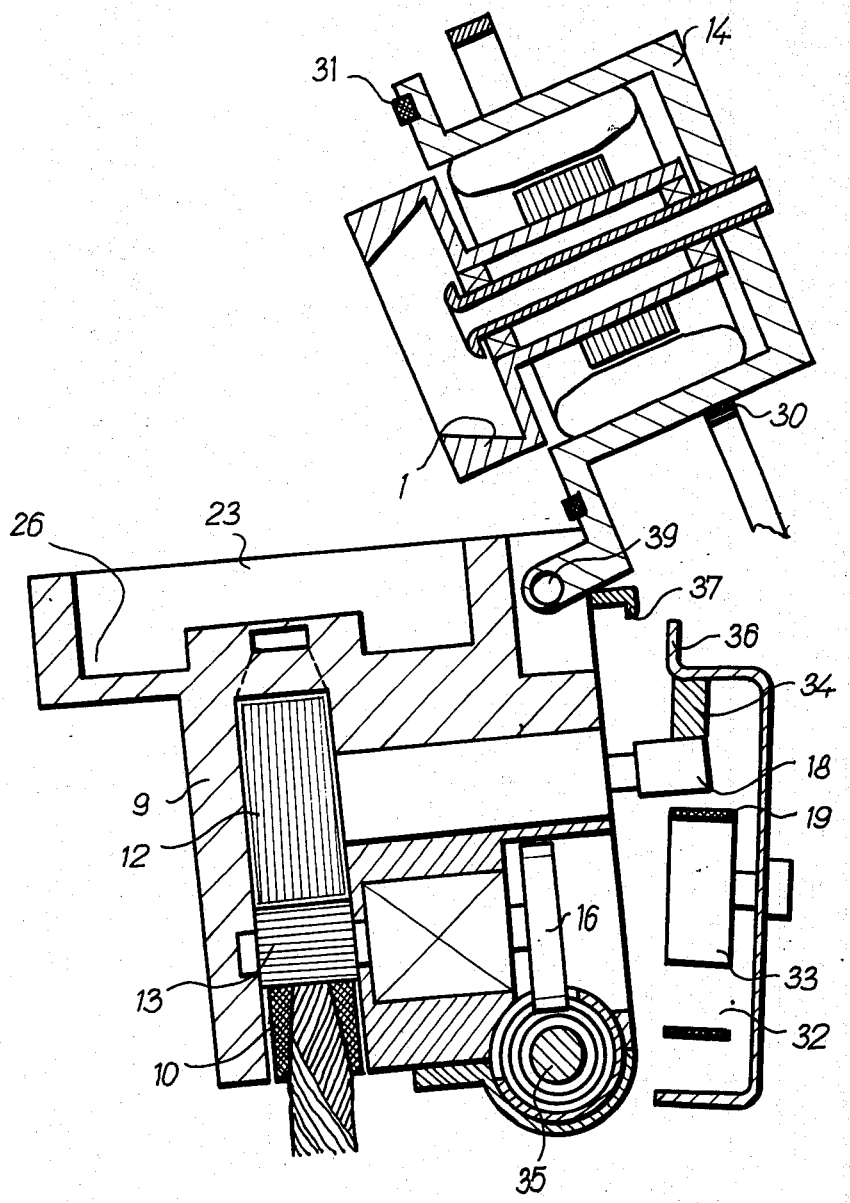
Figure 6:
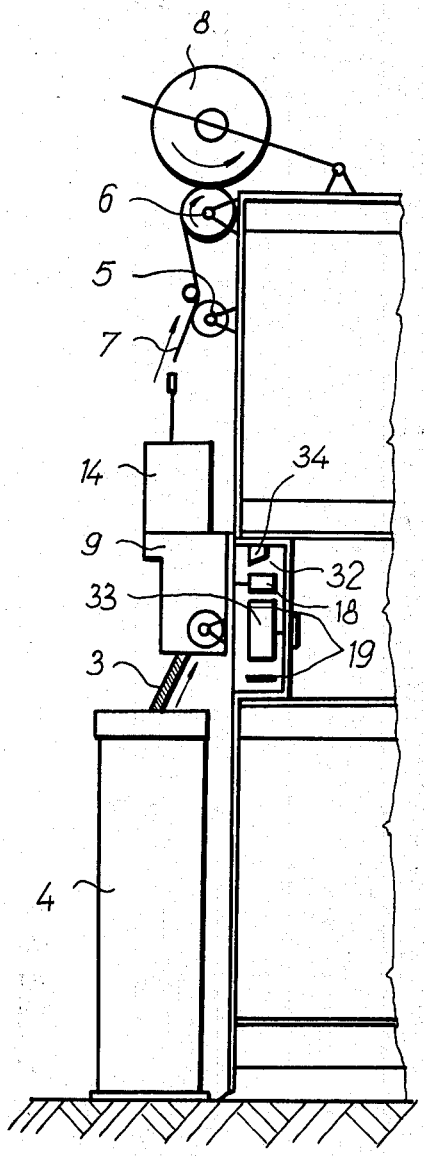

FIGS. 3, 4 and 5 are respective vertical sectional views of a second exemplary embodiment of said housings, FIG. 3 showing the spinning unit in its operating position, FIG. 4 showing the rotor housing in its tilted away position and FIG. 5 showing the two housings in their tilted away positions; and FIG. 6 is a cross-sectional detail view of one side of an open-end spinning machine equipped with spinning units according to the invention.

Figure 1:
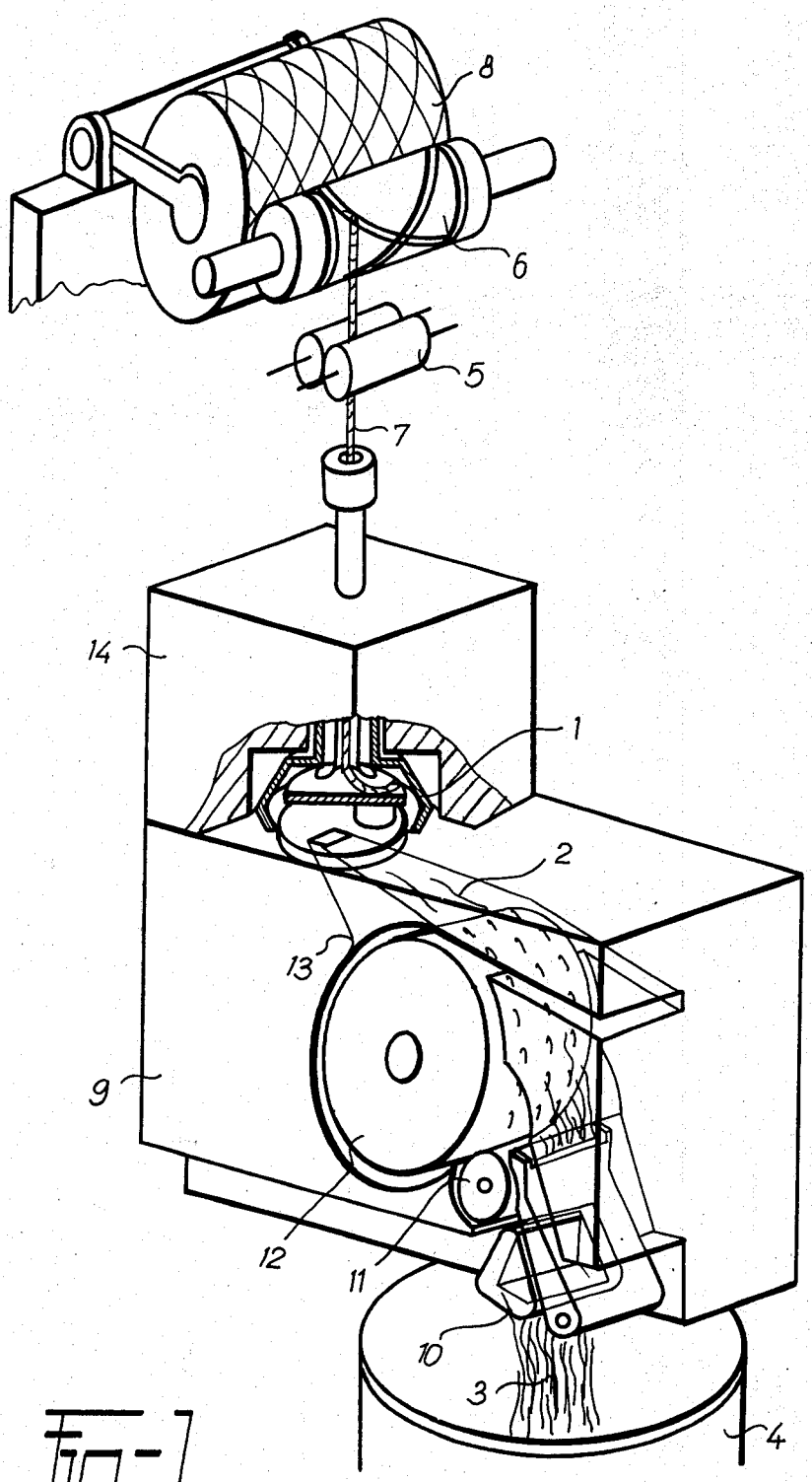
FIG. 1 is a perspective view of an embodiment of the open-end spinning unit according to the invention, wherein the housing of the spinning rotor and the housing of the fiber separating device are shown partially in section.

The open-end spinning unit shown in FIG. 1 comprises a spinning rotor 1 below which a device is arranged for separating fibers 2 from a sliver 3 (FIG. 1 and 6) received in a can 4. Above the spinning rotor 1 there is provided a pair of yarn take-off rollers 5 and above the latter there is disposed a yarn distributing cylinder 6 for winding yarn 7 onto a bobbin.

Figure 2:
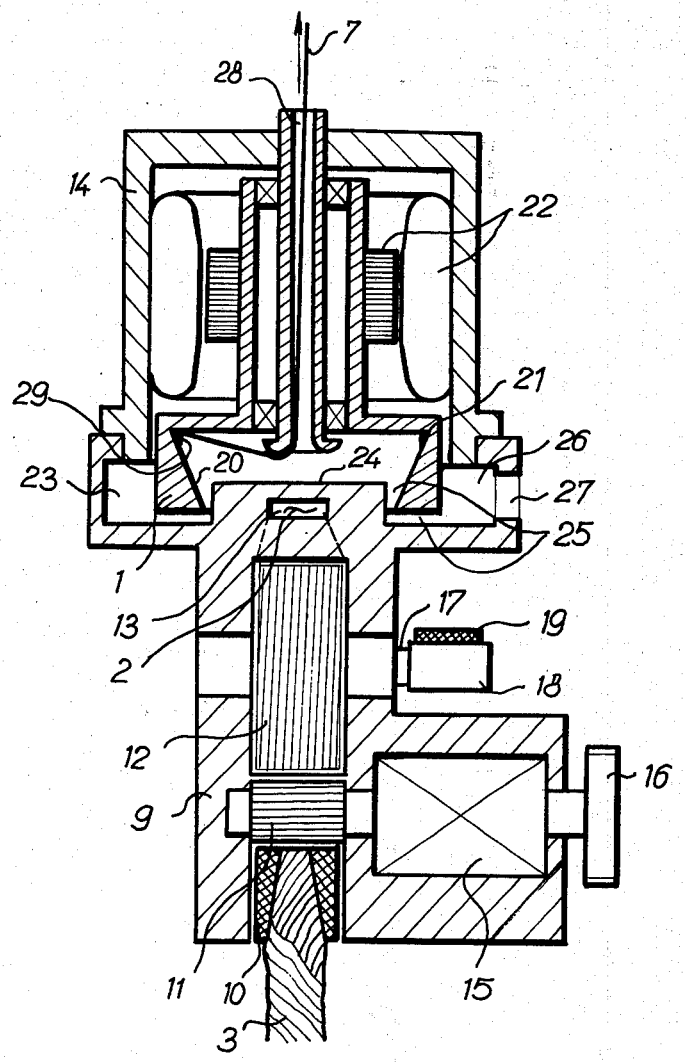
FIG. 2 is a vertical sectional view of a first exemplary embodiment of said housings.

In FIG. 2 there are shown two housings, the lower of them, i.e. the housing 9 of the fiber separating device, containing a means 10 for condensing the sliver 3, a supply roller 11 with a cooperating presser foot (not shown), and above the latter a combing-out cylinder 12 followed by a fiber supply duct 13 to convey the separated fibers 2 into the interior of the spinning rotor 1 which is disposed in the upper housing 14. The axes of rotation of the supply roller 11 and of the combing-out cylinder 12 are horizontal and perpendicular to the longitudinal axis of the machine. The supply roller 11 is coupled via a clutch 15 with a gear wheel 16 of a transmission mechanism which will be hereinafter described. The combing-out cylinder 12 and a pulley 18 connected thereto are supported by a shaft 17. Pulley 18 is shown in FIG. 2 in driving engagement with a common tangential driving belt 19 for driving the combing-out cylinders 12 on either side of the open-end spinning machine.

The spinning rotor 1 has a conical interior with a slide wall 20 and a collecting surface 21 arranged around the cone base and designed to collect a fibrous ribbon 29. Rotor 1 is disposed vertically and is individually driven by a motor 22 arranged above the rotor 1 in the housing 14. The open frontpart of the spinning rotor 1 is inserted into a cavity 23 provided in the top part of the housing 9 of the fiber separating device. The central portion of the bottom of the cavity 23 is constituted by a lid 24 inserted into the front opening of the spinning rotor 1. A fiber supply duct 13 extends through lid 24. Between the lid 24 and the edge of the front opening of the spinning rotor 1 there is provided a gap 25, such gap being designed to withdraw air from the rotor interior into an air-collecting space 26 which is provided in the cavity 23 and surrounds the rotor 1. This air-collecting space 26 communicates via an aperture 27 with a central air offtake duct extending along the machine interior (not shown).

Within the axis of the motor 22 there is provided a yarn take-off duct 28 discharging yarn from the spinning rotor 1 at the top side of the latter.

The open-end spinning unit according to the invention and shown in FIGS. 1 and 2 operates as follows:

Fibers 2 are separated by the combing-out cylinder 12 from the sliver 3 taken off from the can 4 by the supply roller 11, pass through the condenser 10 and are sucked into the interior of the spinning rotor 1 through the supply duct 13 by the air stream created by a sub-atmospheric pressure prevailing in the rotating spinning rotor 1. Due to inertia and air stream, the fibers 2 discharged from the supply duct 13 are directed towards the slide wall 20 of the rotor. Due to centrifugal force, the fibers 2 slide upon said wall 20 to the collecting surface 21 on which a fibrous ribbon 29 is formed, the fibrous ribbon being twisted by the rotation of the rotor to form the yarn 7.

The yarn 7 is then taken off by means of the take-off rollers 5 through the take-off duct 28, whereupon it is distributed by the distributing cylinder 6 to form a cross-wound package on the bobbin 8.

Since the separated fibers 2 are supplied to the lower side of the spinning rotor 1 and the yarn 7 is withdrawn therefrom at its upper side, the open-end spinning unit operates upon the co-current flow principle.

The second illustrative embodiment, shown in FIGS. 3, 4 and 5, differs from that illustrated in FIG. 2 in that in FIGS. 3, 4, and 5 the housings 9 and 14 are made tiltable with respect to each other. Moreover, FIGS. 3, 4 and 5 show the driving mechanism of the fiber separating device and a part of the machine frame.

In the second embodiment the housing 9 of the fiber separating device is provided at its top part with a pivot 39 supporting the housing 14 of the spinning rotor 1 so as to swing from its operative position, shown in FIG. 3 to a hinge-away or inoperative position shown in FIG. 4. In FIG. 4 the tilted away housing 14 engages a fixed stop 30.

As is apparent in FIG. 4, in the second illustrative embodiment the housing 14 of the rotor 1 can be tilted away independently of the position of the housing 9 of the fiber separating device at any desired time, while the tilt angle which is limited only by the position of the stop 30, can be made as large as necessary to provide easy access to the spinning rotor 1.

As is also apparent in FIG. 4, after tilting the housing 14 the spinning rotor 1 can be easily cleaned, the impurities being swept therefrom into the cavity 23. Since the cavity 23 permanently communicates with the central air take-off duct, all the impurities can be easily withdrawn into said duct.

In order that the air-collecting space 26 shall be effectively sealed during the operation of the rotor, the lower wall of the housing 14 can be provided, for instance, with an elastic gasket 31. The gasket 31 can be made, e.g. from rubber containing dispersed magnetic powder providing a magnetic attraction of the two housings 9 and 14, when one or both of housings 9 and 14 are made of ferromagnetic material, whereby the stability of the spinning rotor housing may be improved. The gasket 31 can be provided, alternatively, on the front part of the housing 9 of the fiber separating device. The gasket 31 also provides for the cushioning of housing 14 when it is swung from inoperative to operative position and for the damping of vibrations when the rotor is in operation.

As is apparent from FIGS. 3, 4 and 5 as well as from FIG. 6, in the machine frame there is provided a longitudinal recess 32 in which, on the one hand, a belt 19 for the common drive of all the combing-out cylinders 12 and the belt supporting pulleys 33 are disposed and, on the other hand, the pulleys 18 as well as brakes 34 for stopping the combing-out cylinders 12 are arranged.

The mechanism for driving the sliver supply roller 11 is shown in FIGS. 3, 4 and 5. The gear wheel 16 forms a part of the transmission mechanism coupled with the driving shaft 35 extending parallel with the longitudinal machine axis. The housing 9 of the fiber separating device is pivotally supported on this shaft 35 so as to swing from an operative position (FIG. 3) into an inoperative position shown in FIG. 5. In the latter position, the pulley 18 of the combing-out cylinder 12 is spaced apart from the belt 19 and is engaged by the brake 34. The tilting away of the housing 9 of the fiber separating device and the location of the driving means as well as the brakes 34 for the combing-out cylinders 12 in the longitudinal recess 32 in the machine frame facilitate access to said driving means and enable the belt 19 or its supporting pulleys 33 to be easily exchanged, adjusted or cleaned, respectively. As it can be seen in FIGS. 3, 4 and 5, the frame part bearing longitudinal recess 32 is provided at its top side with a flange 36 while the housing 9 of the fiber separating device is provided with a pawl 37 to secure said housing 9 in the operative position by the engagement of the pawl 37 with said flange 36. If the brakes 34 are not used at all, the housing 9 can be tilted away as much as at an angle of 90°, whereby the access to said housing 9 and to said driving means received in the recess 32 could be substantially improved.

Although the invention is illustrated and described with reference to a plurality of preferred embodiments thereof, it is to be expressly understood that it is in no way limited by disclosure of such a plurality of embodiments, but is capable of numerous modifications within the scope of the appended claims.

What is claimed is:

1. In an open-ended spinning unit having a first housing, a second housing connected to and disposable in confronting relation to the first housing, a spinning rotor rotatably carried in the first housing, means defining an air-collecting space surrounding the spinning rotor, a combing-out cylinder rotatably supported in the second housing, a sliver supply roller rotatably supported in the second housing in spaced relation to and cooperable with the combing-out cylinder to supply to the combing-out cylinder a sliver to be separated into fibers, a lid disposed in the second housing, a fiber supply duct supported in the second housing and communicating with the outlet of the combing-out cylinder, the supply duct extending through the lid in the second housing, and a takeoff duct communicating with the spinning rotor for withdrawing yarn therefrom, the improvement in which the spinning rotor has a vertical axis of rotation; in which the unit further comprises a separate motor disposed in the first housing for driving the spinning rotor; in which the takeoff duct extends coaxially upwardly from the spinning rotor; in which the second housing comprises means defining a cavity between a portion of the lid and the surrounding wall of the second housing; and in which a portion of the spinning rotor extends into the cavity of the second housing when the first and second housings are in confronting relation, the portion of the cavity between the extending portion of the spinning rotor and the surrounding wall of the second housing constituting the air-collection space.

2. A unit as defined in claim 1, further comprising means for pivotally mounting the first housing for movement between an operative position superposed on and confronting the second housing and an inoperative position spaced from the second housing, and stop means disposed in spaced relation to the first housing for limiting the pivotal movement of the first housing.

3. A unit as defined in claim 2, further comprising an elastic gasket carried by one of the respective confronting surfaces of the first and second housings for engagement with the other of the confronting surfaces when the first housing is in its operative position.

4. A unit as defined in claim 2, further comprising a magnetic element carried by one of the confronting surfaces.

5. A unit as defined in claim 1, further comprising a pulley coaxial with an affixed to the combing-out cylinder, a transmission mechanism including a drive belt, and means disposed in the transmission mechanism for pivotally supporting the second housing for movement between an operative position in which said pulley is in engagement with the drive belt and an inoperative position in which said pulley is spaced from the belt.

6. A unit as defined in claim 5, in which the transmission mechanism further comprises a brake positioned to engage said pulley when the second housing is in its inoperative position.

7. A unit as defined in claim 5, further comprising a frame disposed around the transmission mechanism and having a flange, and in which the second housing has a pawl member engageable with the flange of the frame to secure the second housing in its operative position.

* * * * *